United States Patent [19]

Marks

[11] 4,227,763

[45] Oct. 14, 1980

[54] COMMONING CONNECTOR

[75] Inventor: Richard L. Marks, Mechanicsburg, Pa.

[73] Assignee: AMP Incorporated, Harrisburg, Pa.

[21] Appl. No.: 28,479

[22] Filed: Apr. 9, 1979

Related U.S. Application Data

[63] Continuation of Ser. No. 895,173, Apr. 10, 1978, abandoned.

[51] Int. Cl.[3] ..... H01R 4/24; H01R 11/20

[52] U.S. Cl. ..... 339/99 R; 339/132 B; 339/217 S

[58] Field of Search ..... 339/96–99, 339/132, 217 S

[56] References Cited

U.S. PATENT DOCUMENTS

| | | | |
|---|---|---|---|
| 3,617,983 | 11/1971 | Patton | 339/98 |
| 3,668,301 | 6/1972 | Faulconer | 174/88 R |
| 3,777,223 | 12/1973 | Chandler | 174/12 A X |
| 3,812,449 | 5/1974 | Elm | 339/98 |
| 3,822,416 | 7/1974 | Haag et al. | 339/125 R |
| 3,899,237 | 8/1975 | Briggs, Jr. | 339/99 R |
| 3,942,860 | 3/1976 | McDonough | 339/217 S |
| 3,963,319 | 6/1976 | Schumacher | 339/17 F |
| 3,975,812 | 8/1976 | Fleishhacker | 29/203 MW |
| 4,017,140 | 4/1977 | Reavis, Jr. | 339/98 |
| 4,066,320 | 1/1978 | Goodrich et al. | 339/98 |
| 4,159,158 | 6/1979 | Weidler | 339/97 P |

FOREIGN PATENT DOCUMENTS

| | | | |
|---|---|---|---|
| 2131769 | 12/1972 | Fed. Rep. of Germany | 339/97 P |
| 2286520 | 4/1976 | Fed. Rep. of Germany | 339/98 |
| 2311423 | 4/1976 | France | 339/98 |

*Primary Examiner*—John McQuade
*Assistant Examiner*—John S. Brown
*Attorney, Agent, or Firm*—Frederick W. Raring

[57] ABSTRACT

Commoning connector for conductors comprises an insulating housing having a terminal-receiving face into which a plurality of terminal-receiving cavities extend. Electrical terminals in the cavities have wire-receiving portions adjacent to the terminal-receiving face which receive and establish electrical contact with a wire. Adjacent terminals are connected by a connecting strip or buss bar so that wires in adjacent terminals are commonly connected. The connector can be used in harness manufacturing processes which are also described.

5 Claims, 11 Drawing Figures

Fig. 10
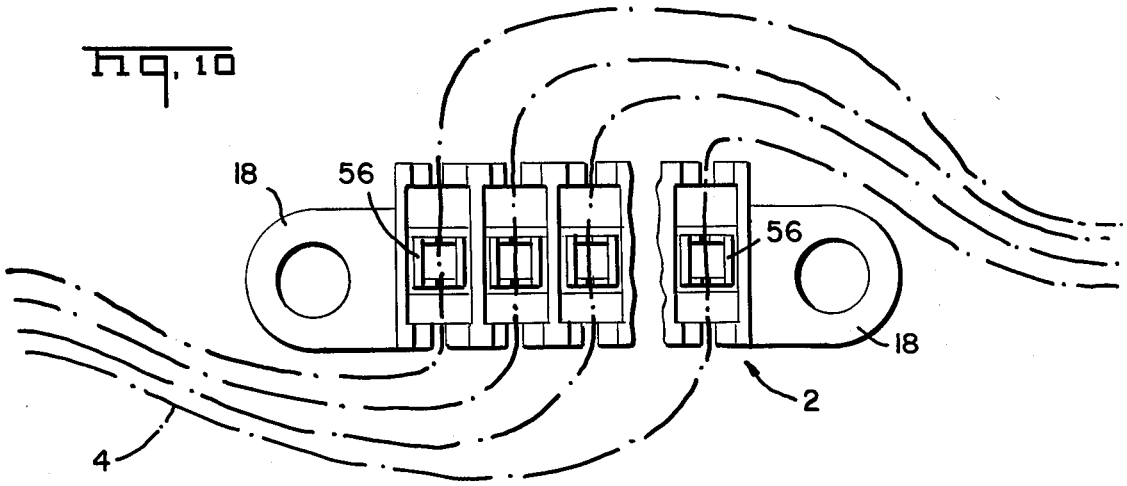
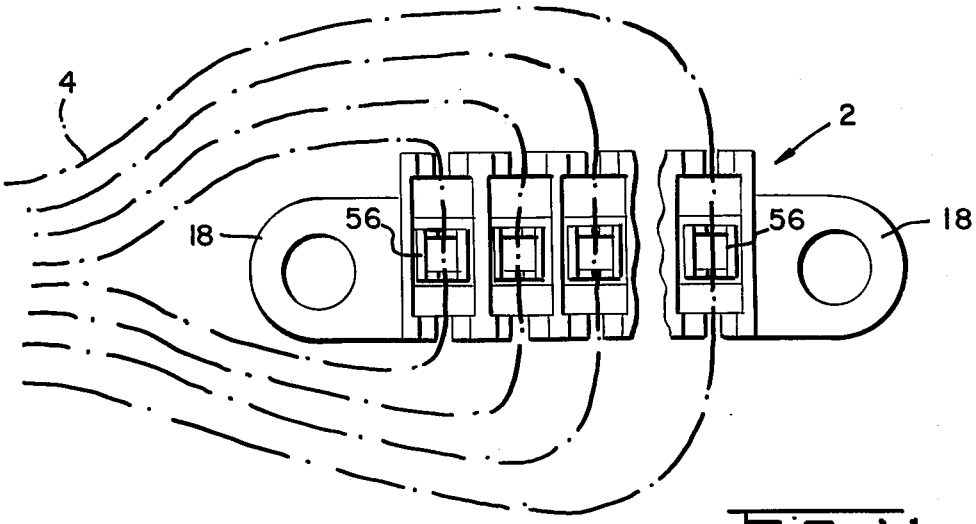
Fig. 11

COMMONING CONNECTOR

This application is a continuation of application Ser. No. 895,173 filed Apr. 10, 1978 and now abandoned.

BACKGROUND OF THE INVENTION

This invention relates to electrical connecting devices which are used commonly to connect a plurality of wires or conductors at one or more electrical junctions. The embodiment of the invention described herein is particularly intended for use in conjunction with electrical connectors of the general type described and claimed in U.S. Pat. No. 4,159,158 dated June 26, 1979 however, other embodiments of the invention will be apparent from the following specification.

A wide variety of connecting devices for commonly connecting a plurality of wires are presently available to the industry. One commonly used type comprises an insulating support on which a plurality of metallic junction bars are mounted. The junction bars are provided with clamping screws which serve to clamp the stripped ends of the conductors to the junction bars thereby to connect them to each other. Other types of commoning connectors have terminal receptacles which receive terminals which are crimped onto the ends of the conductors.

Most, if not all, of the presently available commoning connectors require some preparation of the wires which are being commonly connected such as stripping of the insulation and/or crimping of a terminal onto the wire end. Many, if not most, of the available commoning connectors are constructed such that only the ends of wires can be connected at the junction and it is not practical to connect an intermediate portion of the wire to an electrical junction.

The instant invention is directed to the achievement of an improved commoning connector of greatly simplified structure which can be connected to the end of a wire or to an intermediate portion of a wire without preparation of the wire, such as insulation stripping prior to formation of the connection. The invention is further directed to the achievement of a commoning connector which can be connected to the conductors of a cable during the process of manufacturing an electrical harness consisting of one or more commoning connectors and a plurality of other types of electrical connectors.

It is accordingly an object of the invention to provide an improved electrical connecting device for connecting conductors to each other at electrical junctions. A further object is to provide a connector which does not require preparation of the connector, such as insulation stripping prior to formation of the electrical connection of the wire to the connector. A further object is to provide a commoning connector to which wires can be connected during a harness manufacturing process with the aid of wire insertion tools which simultaneously connect a plurality of wires to an equal number of terminals in the connector. A further object is to provide a connector which can be connected to wires intermediate the ends thereof.

These and other objects of the invention are achieved in preferred embodiments thereof which are briefly described in the foregoing abstract, and are described in detail below and which are shown in the accompanying drawings in which:

FIG. 9 is a view similar to FIG. 8 but showing a fixture which is intended for use with a connector of a type that is mounted on the ends of wires.

FIGS. 10 and 11 are plan views of a connector in accordance with the invention which illustrate the routing of wires to and from the connector.

Figure 1:
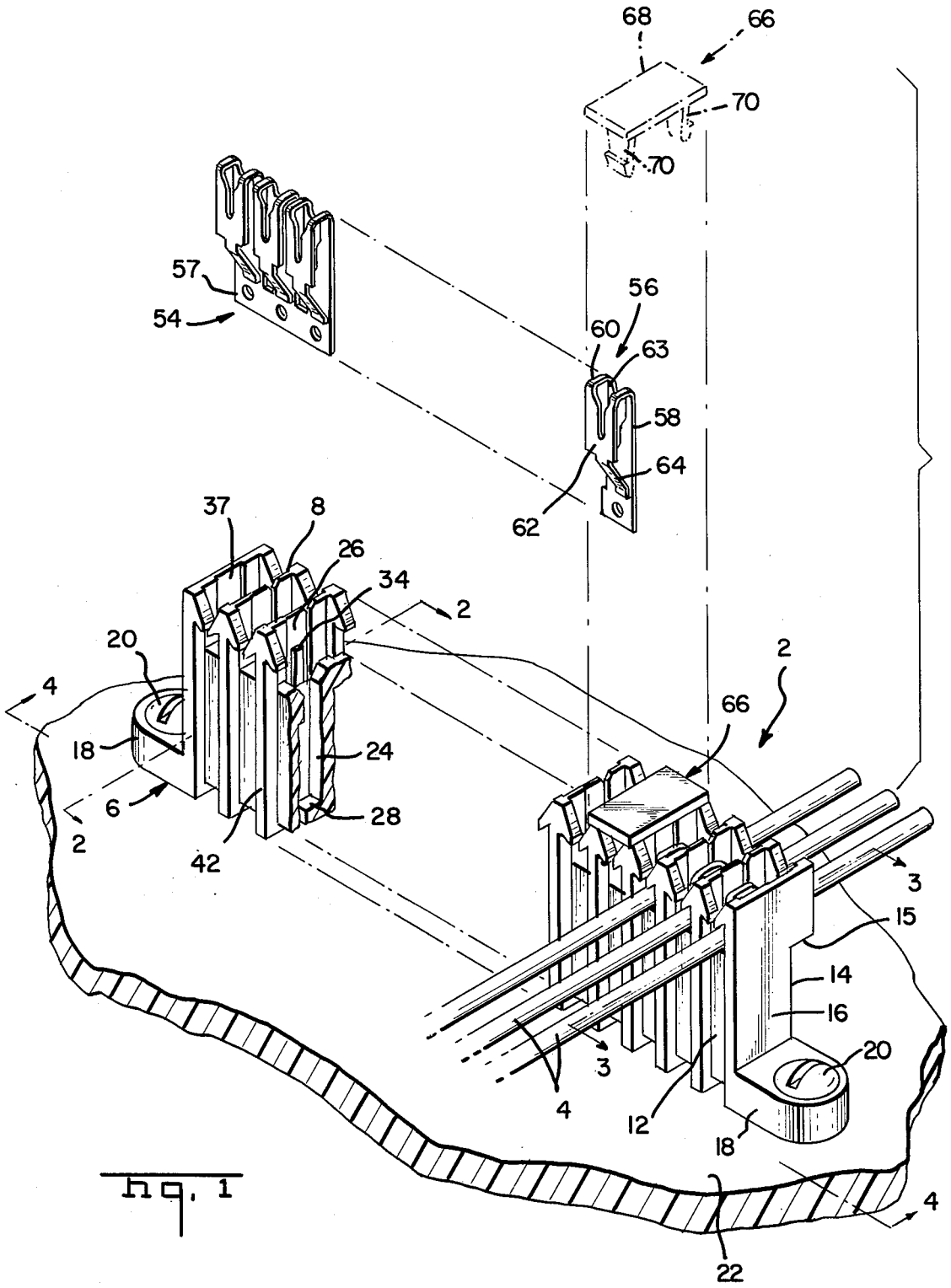
FIG. 1 is a perspective view of a connector in accordance with the invention mounted on a panel member with a strip of electrical terminals exploded from the connector housing.
Figure 2:
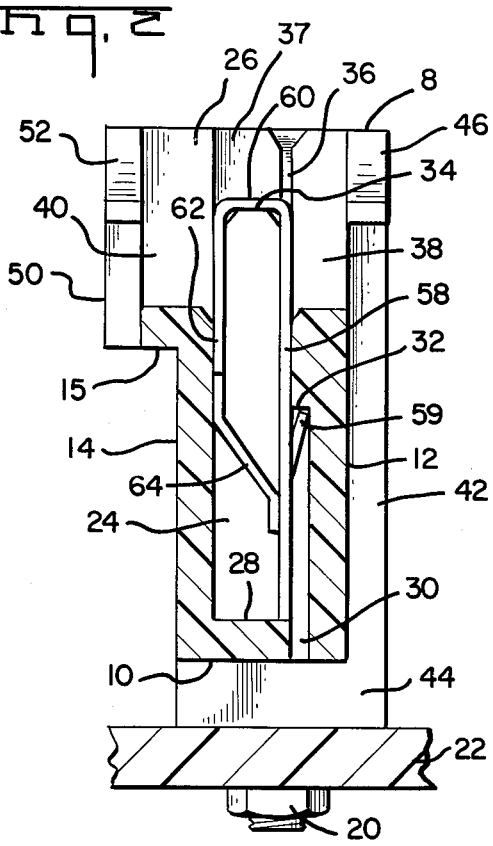
FIG. 2 is a cross-sectional view taken along the lines 2—2 of FIG. 1.
Figure 3:
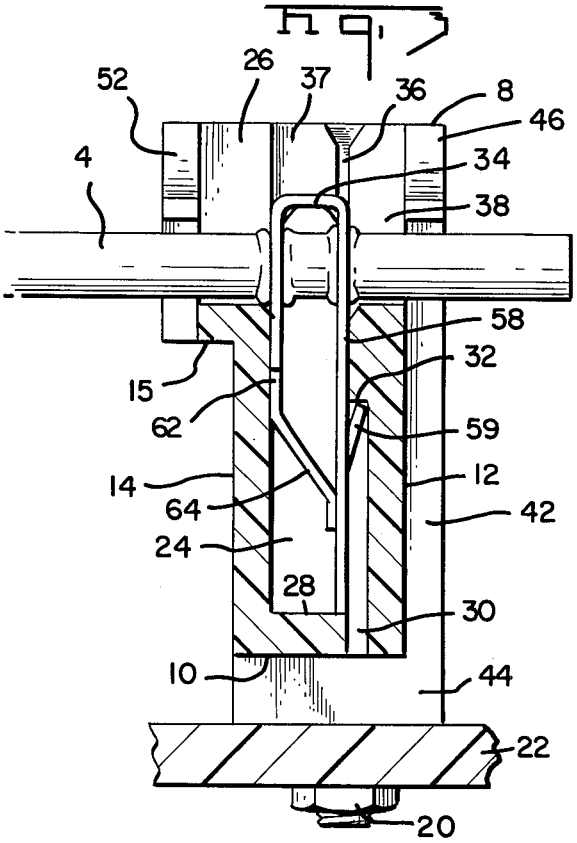
FIG. 3 is a view similar to FIG. 2 but showing a wire connected to the terminal in the housing.
Figure 4:
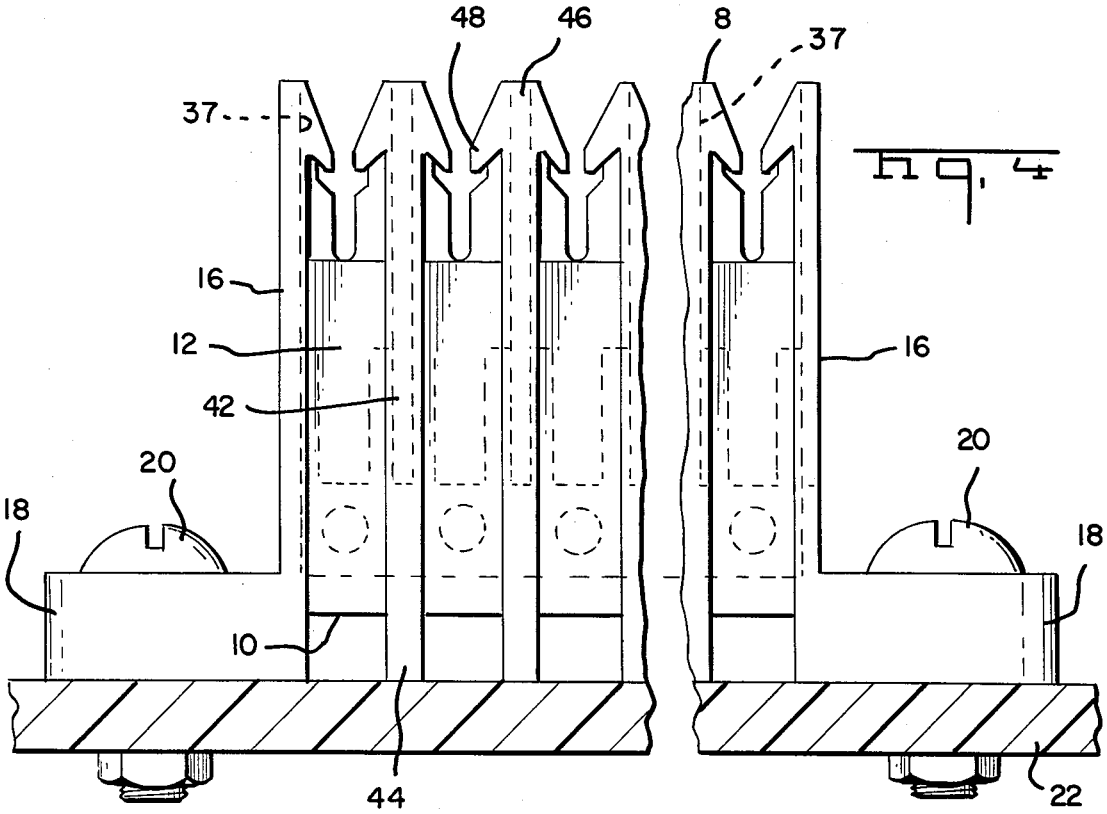
FIG. 4 is a side view of the connector looking in the direction of the arrows 4—4 of FIG. 1.

Referring first to FIGS. 1–4, a commoning connector assembly 2 in accordance with the invention serves to connect a plurality of wires 4 to a common junction point thereby connecting the wires to each other. The connector comprises an insulating housing 6 having a wire-receiving face 8 and a base 10 which is adjacent to the surface of a panel 22 when the connector is mounted on the panel. The housing is preferably produced by injection molding of a suitable thermoplastic material, such as nylon, and has sidewalls 12, 14 and endwalls 16 which extend between the terminal-receiving face 8 and the base 10. Mounting feet 18 extend laterally outwardly from the endwalls 16 and have openings therein so that the connector can be secured to the panel 22 by suitable fasteners 20.

A plurality of side-by-side terminal-receiving cavities 24 extend inwardly from the face 8 and are separated from each other by barrier walls 26 which extend between the sidewalls 12, 14. Each cavity has an inner end 28 which is proximate to the base 10 and an opening 30 extends from this inner end to the base. This opening is formed during the molding process by a core pin which also forms a downwardly facing shoulder 32 in the cavity adjacent to the sidewall 12. Upwardly facing shoulders 34 are provided on the opposed surfaces of barrier walls 26 adjacent to the face 8. These upwardly facing shoulders serve to support the terminals as will be described below and are, in general, in accordance with the teachings of the above identified U.S. Pat. No. 4,159,158. It will be noted that each barrier wall is provided with a slot 36 which extends vertically, as viewed in FIG. 2, from the face 8 substantially to the inner end 28 of the cavity. These slots are provided to permit insertion of a strip of terminals into a group of adjacent cavities, the terminals being connected to a carrier strip 57 which moves through the slots 36. The barrier walls are also provided with vertically extending recesses 37 which receive edge portions of the terminals.

A plurality of spaced-apart ribs 42 are provided on the sidewall 12 and are located in alignment with the barrier walls 26 and between adjacent cavities as best shown in FIG. 1. These ribs extend downwardly to the base 10 and across the base as shown in 44 so that the housing is supported on the ribs rather than on downwardly facing surface of the base 10.

Wire-admitting slots 38 are provided in the sidewall 12 in alignment with each cavity and the upper ends of the ribs 42 are arrow shaped as shown at 46 so that the trailing ends 48 of adjacent arrow-shaped portions define a construction or "one way gate" which permits the wires to move downwardly into the slots but which discourages their upward movement as is apparent from FIG. 1.

The sidewall 14 is offset adjacent to its upper end as shown at 15 and spaced apart ribs 50 are also provided on this offset portion. The ribs 50 are also arrow-shaped at their upper ends as shown at 52 to provide the "one way gate" feature described with reference to the ribs 42.

The contact terminals 56 which are contained in the housing are produced as a continuous strip 54 comprising a carrier strip 57 from which the terminals extend at regularly spaced intervals. Each terminal 56 comprises a first plate-like member 58 which extends from the carrier strip and which is reversely folded at 60 to provide a web and a second or short plate-like section 62. A finger of reduced width 64 extends downwardly as viewed in FIG. 1, from the plate section 62 and obliquely towards the first plate section. The end of this finger bears against the first plate section 58 so that the entire structure is relatively rigid.

Wire-receiving slot means 63 is provided at the upper end of each terminal in the form of an enlarged opening at the web 60 which merges with aligned wire-receiving slots in the plate members 58, 62. The width of the slots is such that upon movement of an insulated wire laterally of its axis and into the slots, the insulation of the wire will be penetrated by the edges of the slots and electrical contact will be established with the conducting core of the wire.

In use, the section of terminal strip 54 is cut from a substantially endless length of such strip and is positioned as shown in FIG. 1 adjacent to the housing with the individual terminals in alignment with the cavities and with the carrier strip 57 in alignment with the slots 36 in the barrier walls 26. The strip is then moved downwardly from the position of FIG. 1 thereby to move the individual terminals into the cavities 24 in the housing with the carrier strip 57 serving as a buss bar. Lances 59 which extend from plate portion 58 lodge against the shoulders 32 and secure the strip in the housing.

The individual wires can then be commonly connected by aligning each wire with a terminal and moving the wire laterally of its axis, through the wire-admitting slots 38, 40 and into the wire-receiving slots of the terminals. This operation of moving the wires into the terminals can be carried out with a suitable hand tool or it can be carried out with an insertion apparatus as will be described below. When it is desired to have more than one electrical junction in a terminal housing, it is merely necessary to insert two lengths of terminal strip into the cavities of the housing. Advantageously, one terminal-receiving cavity is left vacant and is closed off by a cover member 66 having a cap portion 68 and depending locking legs 70. It will be apparent that the cover plate 66 in FIG. 1 immediately indicates that two junctions are being provided in the housing.

It will be apparent from the foregoing description that a commoning connector in accordance with the invention is advantageous for several reasons. As previously mentioned, no wire preparation is required and the insulated wire can be moved directly into the terminal in the housing. The wire can be connected at its end or at an intermediate location to the terminals as shown in FIG. 1, a distinct advantage as compared with many prior art commoning devices which will receive only the end of a wire. Finally, the housing contains no metal parts other than the terminals and the wires are directly connected to these terminals as explained above.

Figure 5:
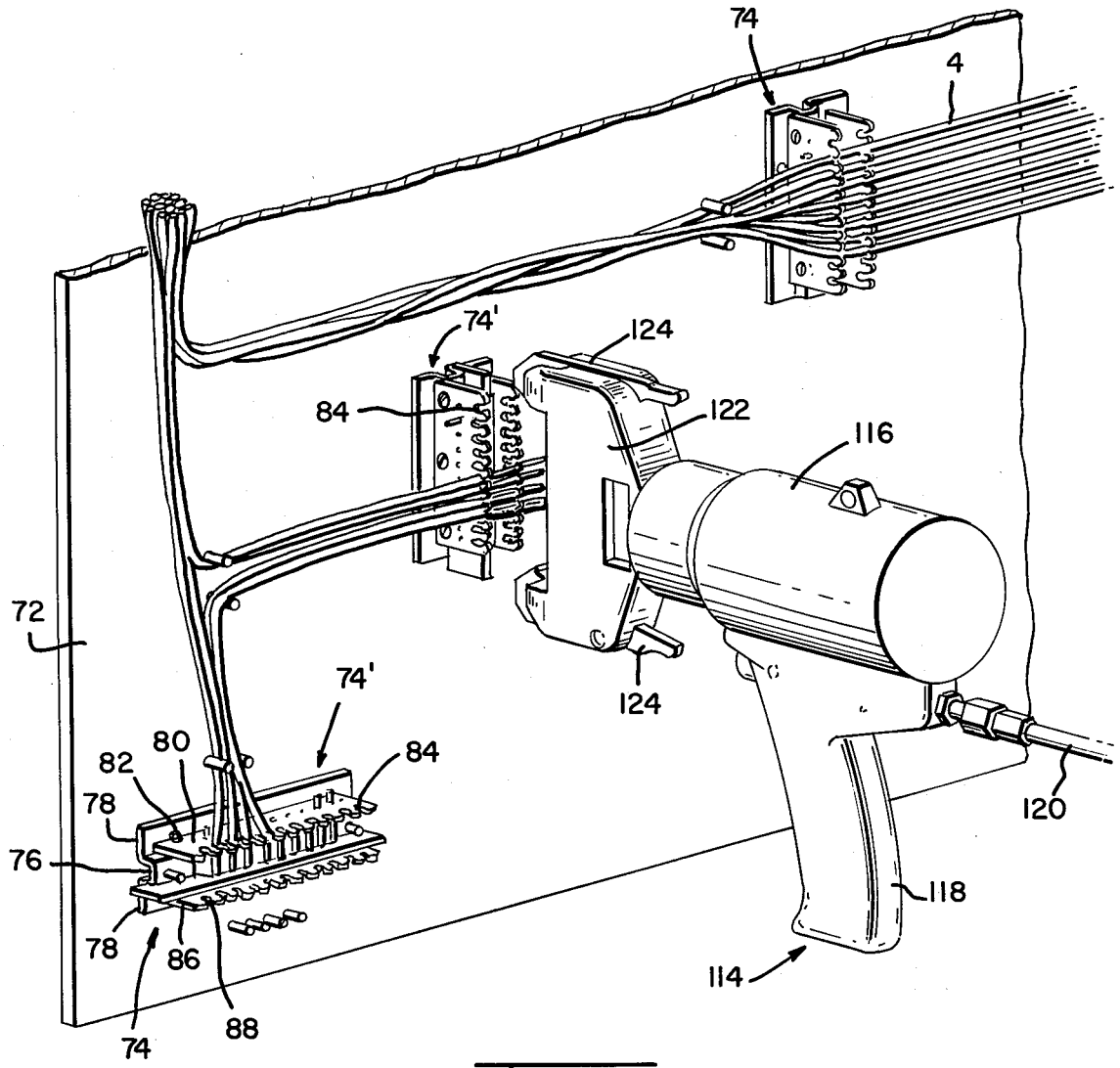
FIG. 5 is a fragmentary perspective view showing a portion of a harness board and illustrating the manufacture of an electrical harness which incorporates a connector in accordance with the invention therein.
Figure 6:
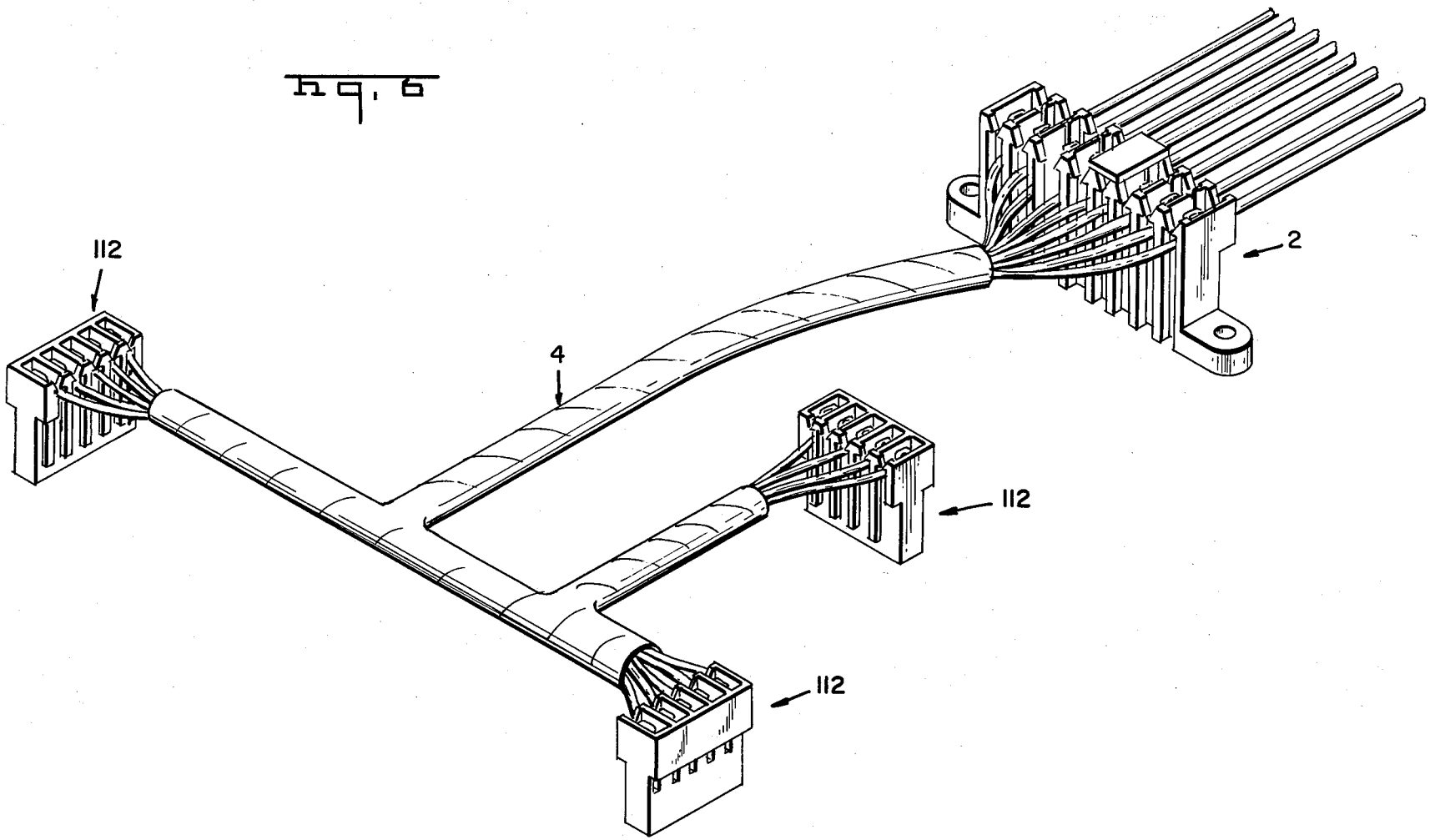
FIG. 6 is a perspective view of a portion of an electrical harness.

Connectors in accordance with the invention can be advantageously used in the manufacture of electrical harnesses as illustrated in FIG. 5–11. The harness manufacturing method illustrated in FIG. 5 is described in detail in U.S. Pat. No. 3,859,724 and is described briefly below. In accordance with this harness manufacturing method, fixtures 74, 74' are mounted on a harness board 72 at locations corresponding to the desired locations of the connectors in the finished harness. Each fixture is dimensioned to receive an electrical connector and has wire locating combs associated therewith by means of which the wires can be positioned in alignment with the terminals in a connector. The individual wires are then laced over the harness board in accordance with the wiring plan of the harness and the wires are located in the fixtures as shown. Thereafter, a wire insertion tool 114 is latched to each fixture and upon actuation of this tool the wires are inserted into the terminals in the connector. In this manner, the harness wires are electrically and mechanically connected to the connector prior to removal of the harness from the harness board and a complete harness ready for use is produced as shown in FIG. 6.

Figure 8:
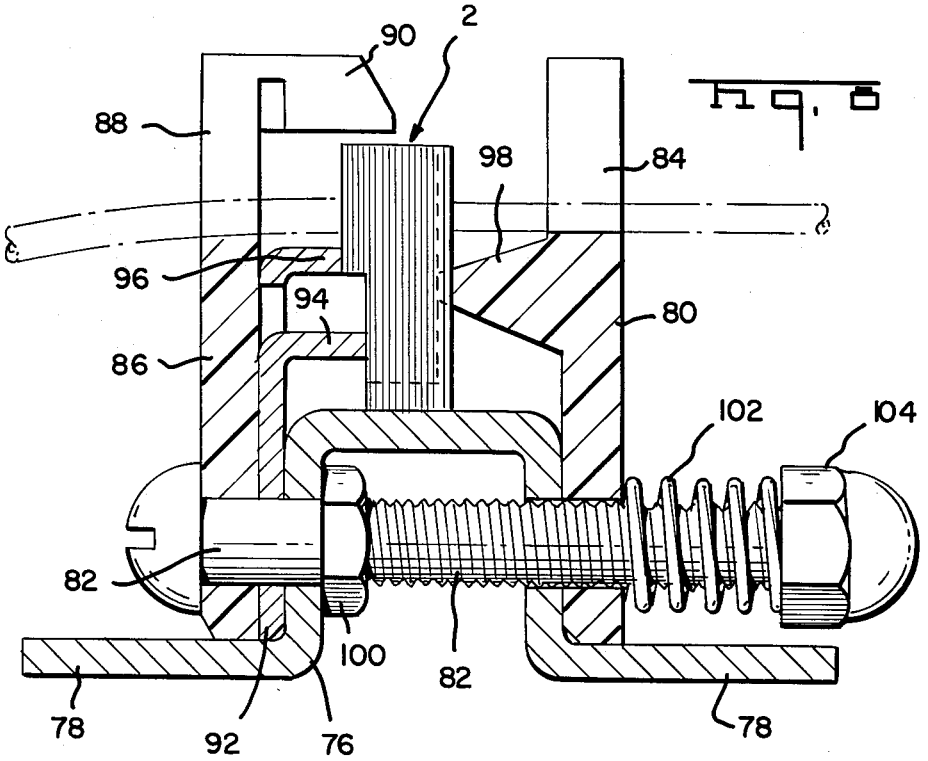
FIG. 8 is a cross-sectional view of the assembled fixture having a connector in accordance with the invention disposed therein in preparation for the connection of wires to the terminal in the connector.

The fixture 74 shown in FIGS. 5 and 8 is adapted to receive a commoning connector assembly 2 as described above and comprises a metallic channel-shaped member 76 having laterally extending feet 78. Wire locating fixtures or combs 80, 86 are mounted against the vertically extending sidewalls of the channel-shaped member 76 and both of these combs have locating recesses as shown at 84 and 88 in their upper ends which receive and position the wires relative to the connectors held in the fixtures. The comb 86 is held rigidly against the left hand side of the channel-shaped member as viewed in FIG. 8 by means of an elongated bolt 82 which extends through aligned holes in the comb 86, in a positioning bar 92, in the channel member and in the comb 80. The end of this bolt projects beyond the comb 80 and a nut 104 is threaded onto the end, a spring 102 being interposed between this nut and the surface of the comb 80. A nut 100 is also threaded on the bolt and serves to clamp the comb 86 and the positioning bar 92 against the left side of the channel member while the channel member 80 can be swung in a clockwise arc in the position shown in order to permit placement of a connector in the fixture and removal therefrom after wires have been connected to the terminals in the connector.

The comb 86 has spaced-apart inwardly directed fingers 90 which assist in locating the wires in alignment with the terminals in the connector. The positioning bar 92 has flanges 94, 96 extending therefrom towards the connector, and these flanges serve to stabilize the connector in the fixture. Precise location of the connector in the fixture is achieved by means of spaced-apart projections 98 on the comb 80 which are dimensioned to enter the space between adjacent ribs 42 on the sidewall 12 of the connector, as shown in FIG. 8.

Figure 7:
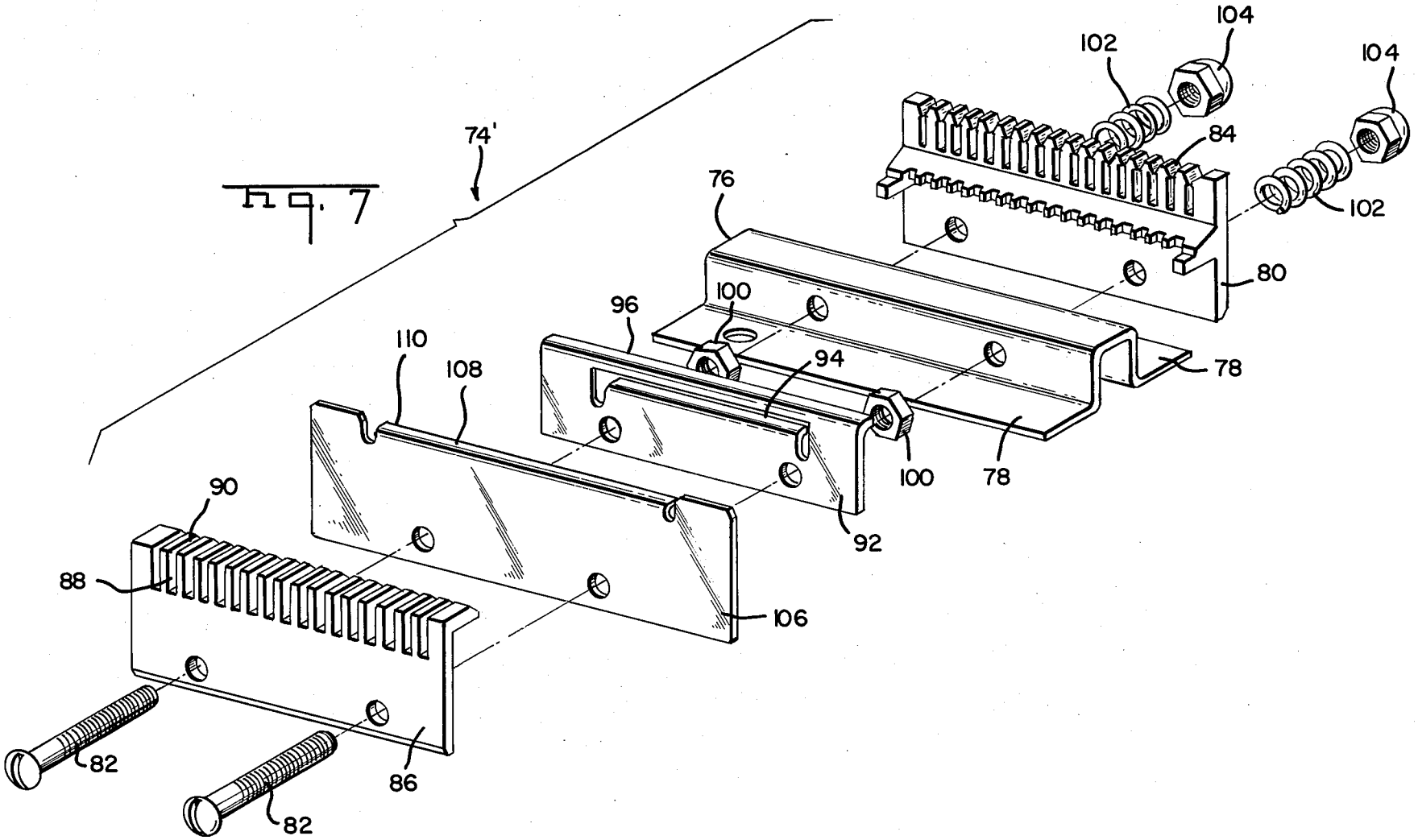
FIG. 7 is a perspective exploded view of a fixture which is used in the harness manufacturing process illustrated in FIG. 5.
Figure 7:
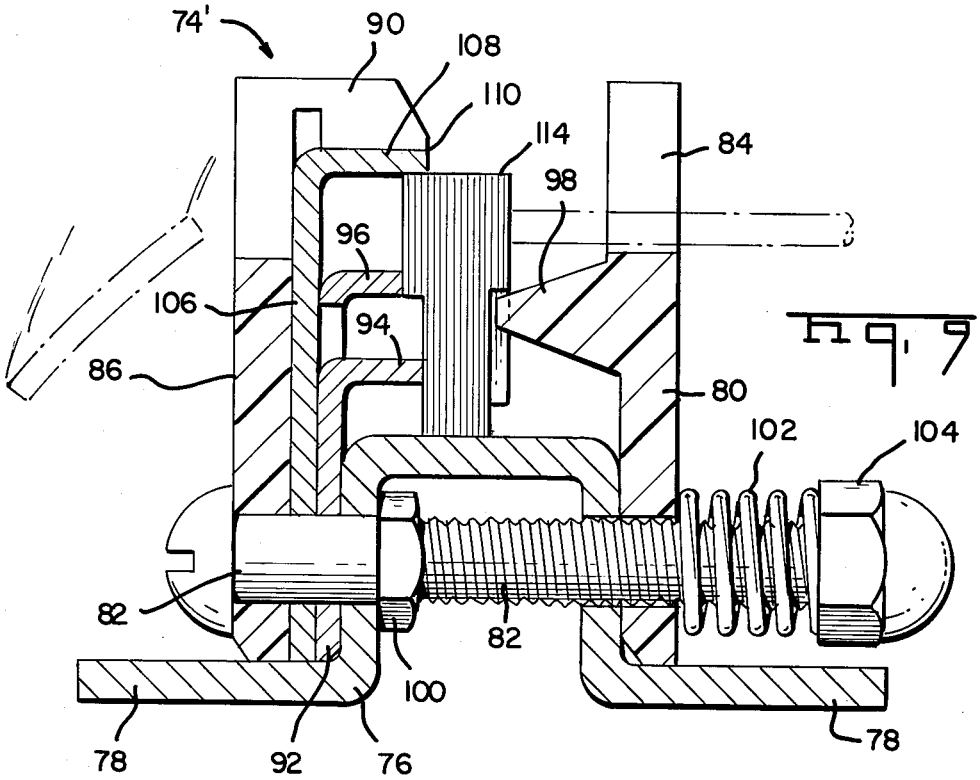

The fixtures 74' (FIGS. 7 and 9) are generally similar to the fixture 74 excepting that a shear bar 106 is provided between the positioning bar 92 and the comb 86. This shear bar has a flange 108 which extends over the connector 112 and provides a shearing edge 110 for severing the wires immediately prior to insertion into the terminals. The shear bar 106 is shown in FIG. 7 but it would not be part of an exploded view of the fixture 74.

The connector 112 is of the type described in the above identified U.S. Pat. No. 4,159,158 and need not be described in further detail here.

The insertion tool 114 comprises a pneumatic piston cylinder 116 having an integral handle 118 and is supplied by compressed air through an air line at 120. An insertion head 122 is mounted on the tool 116 and has pivoted latch arms 124 at each end thereof which permit the tool to be latched to the ends of the channel members 76 of the fixtures. After the wires 4 have been laced over the harness board 72 and positioned in the wire positioning combs as shown in FIG. 5, the operator merely attaches the tool to each fixture 74 or 74' in turn, and actuates the tool thereby to insert the wires into the terminals. The connectors can then be removed from the fixtures by swinging the combs 80 in the clockwise direction from the position shown in FIGS. 8 and 9 and the completed harness can be removed from the board. Wrapping or cable tie devices may be applied to the cables, as shown in FIG. 6.

It will be understood that when the wires are being connected to a connector of the type shown at 112, the wires are trimmed by a movable shearing member in the tool head 122 at the time of insertion. When the wires are inserted into a connector 2 in accordance with the instant invention, they are not sheared and a different tool, which is not provided with a movable shearing member, is used. The general features of the insertion head 122 are in accordance with the teachings of the above U.S. Pat. No. 3,859,724 although the tooling is arranged and constructed specifically for connectors of the type shown at 2 and 112 rather than the connectors disclosed in the above identified U.S. patent.

In FIG. 5, the fixture 74 is positioned such that the wires 4 will extend normally towards one sidewall and normally from the other sidewall. As shown in FIG. 10, the fixture can also be located on the harness board such that the wires will extend towards one of the endwalls 16 of the connector housing and along one of the sidewalls, then transversely through the connector past the other endwall. Alternatively, the wires may extend from the other sidewall back towards the endwall and parallel to their entering direction (FIG. 11).

Connectors in accordance with the invention are advantageous in the manufacture of electrical harnesses for the reason that the commoning connector 2, FIG. 6, is part of the completed harness and when the harness is installed on the equipment for which it is intended, it is merely necessary to secure the connector 2 to a channel member of the equipment such as a chassis surface. The connectors 112 would be mated with complementary connectors or terminal posts.

What is claimed is:

1. An electrical connector for commonly connecting a variable number of electrical conductors in at least two separate groupings, said connector comprising:

an insulating housing having a wire-receiving face, a base, parallel sidewalls and parallel endwalls extending between said wire-receiving face and said base, a plurality of parallel side-by-side terminal-receiving cavities extending into said wire-receiving face, said cavities being arranged in a single row which extends between said endwalls, adjacent cavities in said row being separated by parallel spaced-apart barrier walls which extend between said sidewalls, each of said barrier walls having a carrier strip-receiving slot therein extending from said wire-receiving face to said base, at least two strips of terminal devices in said housing, each of said strips comprising at least two independent spaced-apart terminals extending from an integral carrier strip, said terminals being disposed in at least two adjacent cavities in said housing with said carrier strip extending through said carrier strip-receiving slots in the barrier wall at a location adjacent to said base, each of said terminals comprising a first plate portion which is coplanar with, and which extends laterally from, said carrier strip, said first plate portion being reversely formed at said wire-receiving face to define a second plate portion which extends towards said carrier strip, said first and second plate portions having wire-receiving slots therein for reception of a wire, and wire-admitting slots in each of said sidewalls, and wire-admitting slots being aligned with said wire-receiving slots in said terminals whereby, wires can be commonly connected by locating said wires adjacent to said wire-receiving face with their axes extending normally of said sidewalls and in alignment with said wire-admitting slots and said wire-receiving slots, and thereafter moving said wires laterally of their axes, into said wire-receiving slots of said terminals.

2. An electrical connector as set forth in claim 1 having integral mounting feet extending outwardly from said endwalls adjacent to said base for mounting said connector on a panel.

3. An electrical connector as set forth in claim 2 having spaced-apart parallel ribs on said sidewalls, said ribs being in alignment with said barrier walls.

4. An electrical connector as set forth in claim 3, said ribs on one of said sidewalls extending to, and across said base, whereby, upon mounting said connector on a panel, said base is spaced from the surface of said panel.

5. An electrical connector as set forth in claim 1, said housing having at least two of said strips of said terminal devices therein, one of said terminal-receiving cavities being vacant, said vacant cavity being between said two strips.

* * * * *